US007004897B2

(12) United States Patent
Spivey, Sr.

(10) Patent No.: US 7,004,897 B2
(45) Date of Patent: Feb. 28, 2006

(54) DISPLAY/VENDING CARTON

(75) Inventor: Raymond Rudolph Spivey, Sr., Mableton, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

(21) Appl. No.: 10/770,762

(22) Filed: Feb. 3, 2004

(65) Prior Publication Data

US 2005/0085364 A1 Apr. 21, 2005

Related U.S. Application Data

(60) Provisional application No. 60/511,586, filed on Oct. 15, 2003.

(51) Int. Cl.
*B31B 1/25* (2006.01)

(52) U.S. Cl. ..... 493/59; 493/69

(58) Field of Classification Search ..... 493/69, 493/79, 59, 162, 55; 206/736, 738, 792
See application file for complete search history.

(56) References Cited

U.S. PATENT DOCUMENTS 3,356,279 A 12/1967 Root
4,417,655 A * 11/1983 Forbes, Jr. ..... 206/45.25
4,577,762 A * 3/1986 Kuchenbecker ..... 229/207
4,890,440 A * 1/1990 Romagnoli ..... 53/456
4,949,845 A * 8/1990 Dixon ..... 229/212
4,974,771 A 12/1990 Lavery
5,664,683 A * 9/1997 Brody ..... 206/768
5,690,213 A * 11/1997 Matsumura ..... 206/45.21
5,826,783 A 10/1998 Stout
5,875,961 A * 3/1999 Stone et al. ..... 229/215
5,921,398 A * 7/1999 Carroll ..... 206/736
5,924,559 A * 7/1999 Carrel et al. ..... 206/45.21
6,409,077 B1 * 6/2002 Telesca et al. ..... 229/164
6,752,262 B1 * 6/2004 Boriani et al. ..... 206/45.21
2004/0060972 A1 4/2004 Harrelson

FOREIGN PATENT DOCUMENTS

FR 2 549 010 A1 1/1985
WO WO 99/64301 12/1999
WO WO 2004/043790 A2 5/2004

* cited by examiner

*Primary Examiner*—Eugene Kim
(74) *Attorney, Agent, or Firm*—Womble Carlyle Sandridge & Rice, PLLC

(57) ABSTRACT

A carton with an improved dispensing feature at one end of the carton, which preserves the integrity of the carton, while enabling the display and enhanced access and vending of containers within the carton.

32 Claims, 4 Drawing Sheets

DISPLAY/VENDING CARTON

CROSS REFERENCE TO RELATED APPLICATION

The present invention claims priority to U.S. Provisional Patent Application Ser. No. 60/511,586, filed Oct. 15, 2003.

FIELD OF THE INVENTION

The present invention generally relates to cartons for storage and transport of articles, and in particular, to paperboard cartons incorporating an opening feature so as to define a dispenser for the display and vending of articles or containers stored within the carton.

BACKGROUND OF THE INVENTION

Cartons made from cardboard, paperboard, or similar materials have long been used for the storage and transport of various types of articles such as beverage cans and other foodstuffs. For example, beverages, such as soft drinks and beer, contained within bottles or cans typically are packaged in six, eight, twelve, or even twenty-four pack configurations within paperboard or cardboard cartons. Such cartons have not only been used for the storage and transport of containers such as bottles or cans, but further have been developed with dispensing features including tear-away sections of the cartons to enable dispensing of the articles contained therein. Some of these dispensers, however, suffer from the disadvantage that, once opened, there will be a tendency for more than one container, especially bottles or cans stored therein, to roll out of the carton. Alternatively, many conventional dispensing cartons are provided with dispensing or opening features that often are a limited size or volume to restrict the number of articles that can be removed at any one time, but which also can make it difficult to easily and cleanly remove the containers or other articles stored within the carton. Still further, in retail environments, it is important that products not only be easily accessible to consumers, but also be prominently displayed, which traditionally has led retailers to remove all of the containers or articles from their carton for stacking on shelves for display and easier access.

Accordingly, it can be seen that a need exists for a carton for various types of articles such as beverage cans and other similar articles, which enables the dispensing of the articles substantially one at a time and which addresses the foregoing and other related and unrelated problems in the art.

SUMMARY OF THE INVENTION

Briefly described, the present invention generally relates to a display/vending carton for the storage, transport, display and dispensing or vending of containers stored within the carton. The carton typically will be formed from paperboard, cardboard, or other similar material initially formed as a carton blank. As the carton blank is fed into a packaging machine, the carton blank will be folded into a sleeve in which a series of articles or containers such as beverage cans or bottles, tubes of frozen biscuits, etc., will be loaded or the carton blank otherwise will be folded or wrapped about the articles. The articles or containers typically are loaded in vertically stacked, substantially parallel rows, with there generally being 2–3 rows or more of the containers stacked within the carton. The ends of the carton thereafter will be folded closed and secured such as by adhesive or other fastening mechanism to form an enclosed, display/vending carton.

In one example embodiment, the carton blank will include a top panel attached to a first side panel along a first fold line, and to a second side panel along an opposite side thereof, by a second fold line. Each of the side panels can be connected along third and fourth fold lines to bottom flaps, with the bottom flaps designed to be folded and glued together so as to form or define a bottom panel of the enclosed carton. Alternatively, a bottom panel can be attached to the opposite side of the first side panel from the top panel by the third fold line, while an attachment flap is attached to the second side panel along an opposite edge from the top panel by the fourth fold line. Additionally, fifth and sixth transverse fold lines extend across the bottom side and top panels in a direction normal to the first through fourth longitudinal fold lines, so as to define bottom, side and top end flaps. The end flaps are adapted to be folded together in an overlying configuration for enclosing the ends of the carton after folding of the blank into a sleeve for loading with products and containers therein. One of these closed ends further will be an exiting end at which a dispenser is formed for removal or dispensing of products or containers from the enclosed carton.

A line of weakness or separation generally is formed in the carton at its exiting end and typically includes a series of perforations, cuts, and/or scores so as to define a tear line for a removable opening section of the carton at its exiting end. This enables the opening section to be at least partially torn away or removed from the carton to form a dispenser opening for removal and/or dispensing of the containers from the carton. A first portion of the tear line generally will extend laterally across the front of the exiting end of the carton, through the side end flaps, and then will be turned and extended upwardly through the side end flaps toward the first and second fold lines between the side panels and top panel. The tear line thereafter will include a section or portion that extends across the top panel.

In use, the opening section generally will be torn away from the exiting end of the carton along the tear line to form the dispenser opening through which containers or products stored within the carton can be removed. The opening section typically will be hingedly attached or pivoted rearwardly along the section of the tear line across the top panel to provide a recloseable flap, although it further can be completely separated from the carton via the tear line and removed as needed.

Alternatively, the tear line can be further extended along the first and second fold lines to enable removal of a more substantial portion, and potentially all of the top panel as needed or desired. In addition, the tear line can be extended through the side panels in locations spaced from and extending parallel to the fold lines between the top and side panels as needed to provide a further enlarged dispenser opening for the display and withdrawal or removal of products or containers from the carton.

Various objects, features, and advantages of the present invention will become apparent to those skilled in the art upon reading the following detailed description when taken in conjunction with the accompanying drawings.

DETAILED DESCRIPTION OF THE INVENTION

Figure 1:
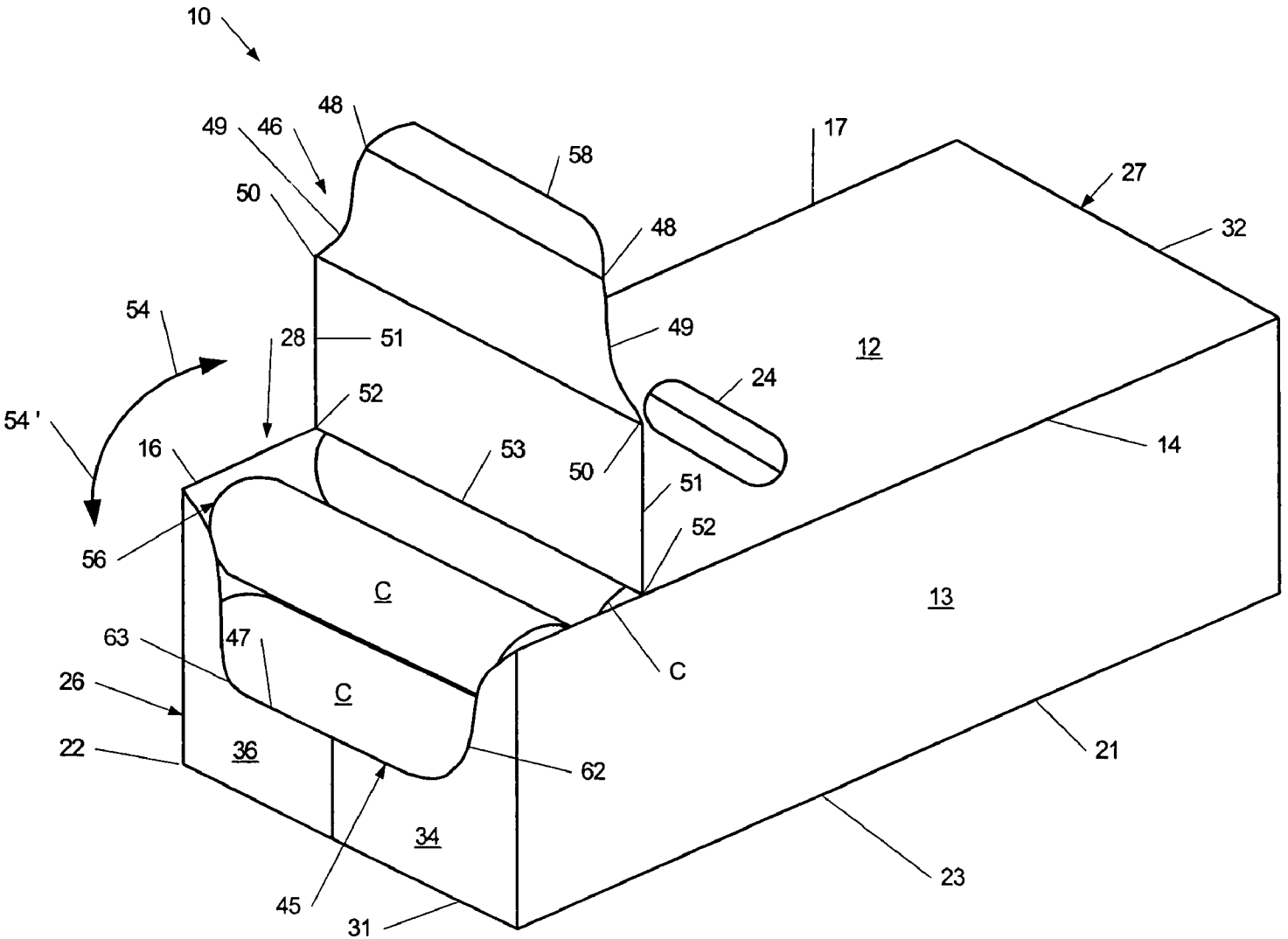
FIG. 1 is a perspective view of one example embodiment of the display/vending carton of the present invention.
Figure 2:
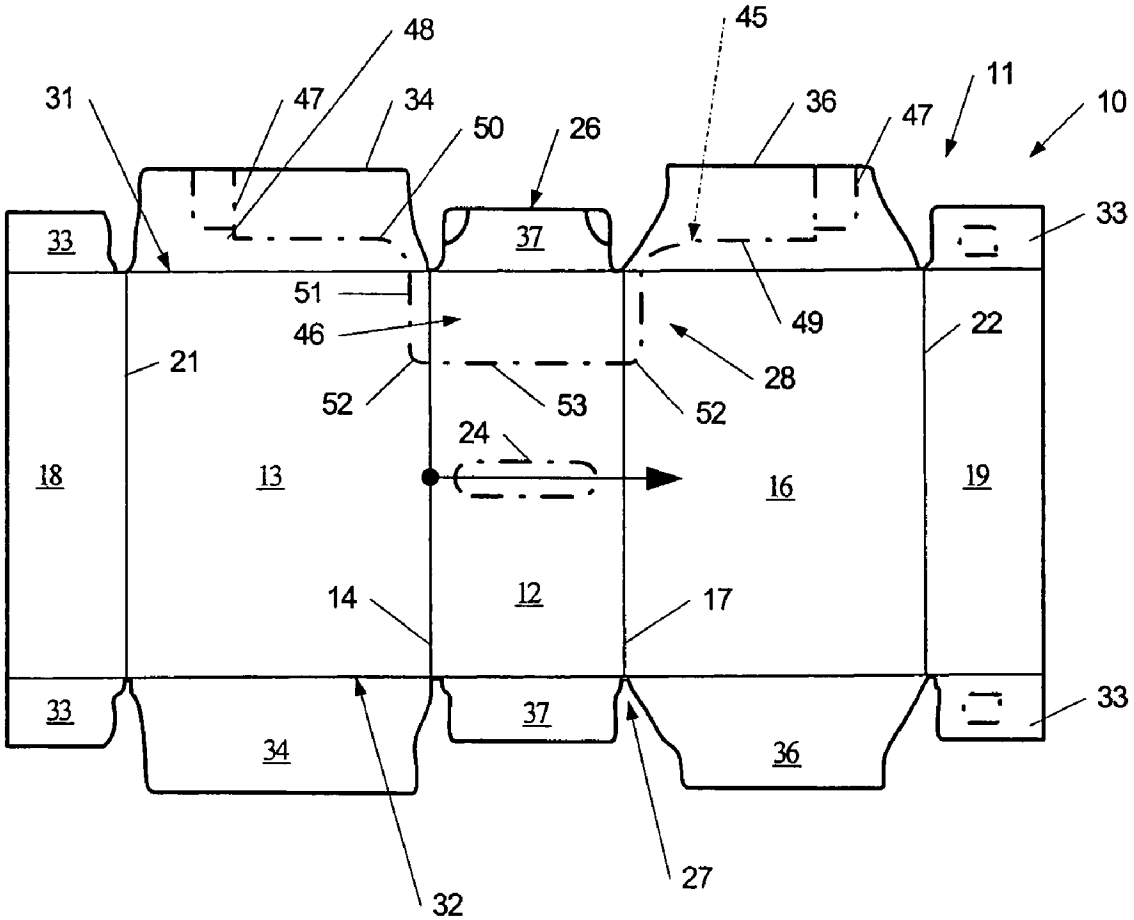
FIG. 2 is a plan view of a carton blank from which the display/vending carton according to FIG. 1 is formed.
Figure 3:
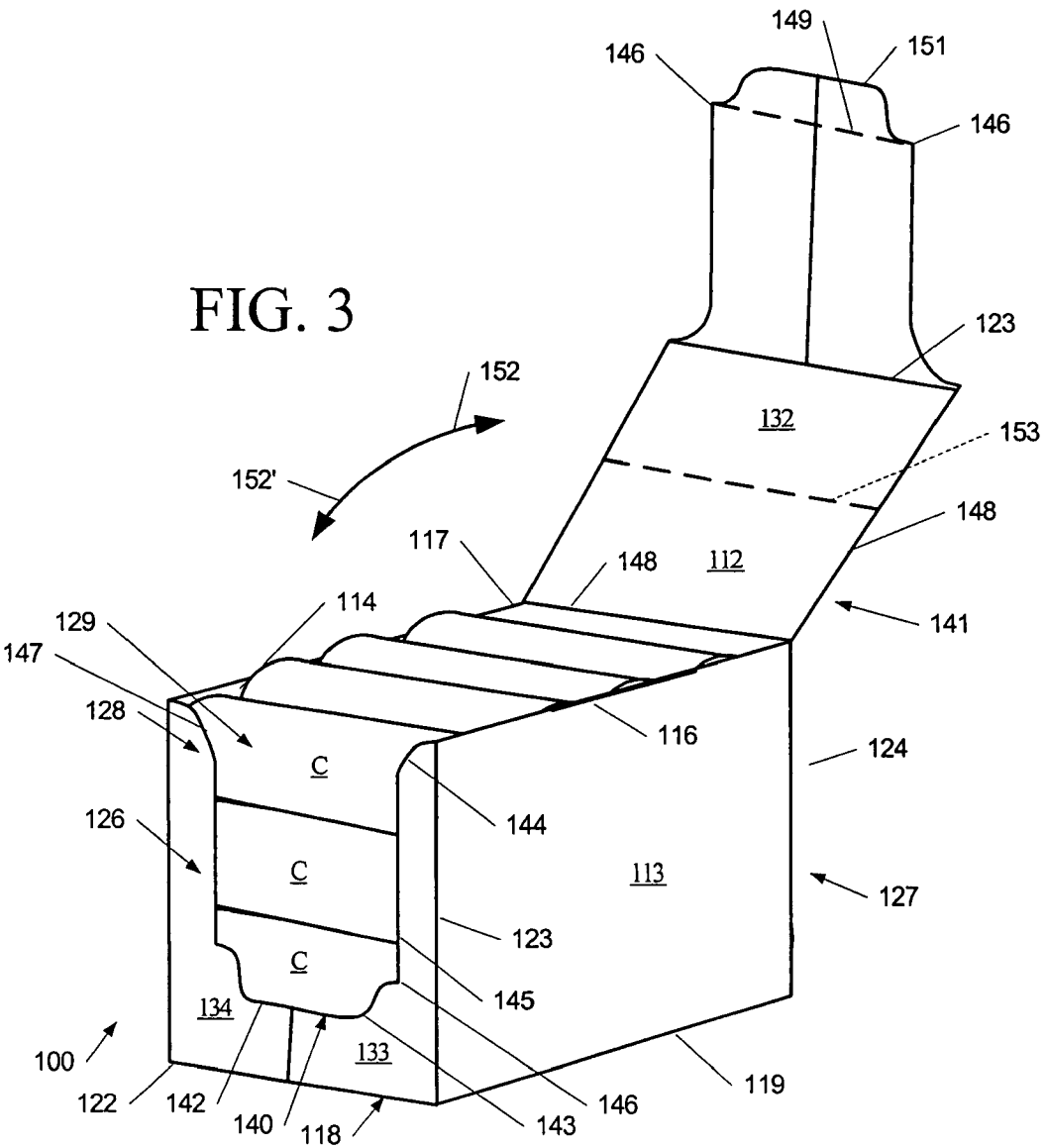
FIG. 3 is a perspective illustration of an additional, alternative embodiment of the display/vending carton of the present invention.

Referring now to the drawings in which like numerals indicate like parts throughout the several views, FIGS. 1–4 generally illustrate example embodiments of the display/vending carton 10/100 of the present invention, which is primarily designed for the storage, transport, display and vending of cans, bottles, and similar products. For example, the present application can be used with cans and bottles of the types used to contain soft drinks and beer or other liquid products, as well as cans or tubes of various types of food products such as frozen biscuits, rolls and the like. It will, however, also be understood that the present invention further can be adapted for use in the storage, transport, display and vending and/or dispensing of various other types or configurations of products other than substantially cylindrically shaped bottles or cans. In addition, while the cartons 10/100 of FIGS. 1 and 3 are shown with 2–3 rows of stacked containers C therein (i.e., in a 2×6, 3×4, etc. arrangement), it will be understood by those skilled in the art that the present invention is not restricted solely to two or three rows of containers, but rather can be used for storage, transport, display/vending, and/or dispensing of containers in a variety of varying arrangements or configurations, including 2×4, 2×5, 2×6, 3×4, 3×5, etc.

In a first embodiment of the present invention generally illustrated in FIGS. 1 and 2, the carton 10 generally will be formed from a carton blank 11 that itself is generally formed from a foldable sheet of material such as paperboard, cardboard, plastic or other, similar materials as commonly used in the packaging industry or field. As generally illustrated in FIG. 2, the carton blank 11, shown in a flat, unfolded configuration, includes a top panel 12 connected to a first side panel 13 by a first longitudinal fold line 14 and to a second side panel 16 by a second longitudinally extending fold line 17, which second fold line 17 extends parallel to the first fold line 14. The first and second side panels 13 and 16, respectively, are each attached at their edges opposite the top panel to first and second bottom flaps 18 and 19 by longitudinally extending third and fourth fold lines 21 and 22, respectively, which fold lines extend parallel to the first and second fold lines 14 and 16 as generally illustrated in FIG. 2. The bottom end flaps 18 and 19 generally are adapted to be folded together into an overlying configuration and attached together, typically with an adhesive material, although they also can be formed with mating tabs and slots (not shown) for locking the bottom flaps together to define and form a bottom panel 23 (FIG. 1) for the enclosed carton 10.

The carton 10 further generally includes a handle 24, which can be formed as a slot type handle as shown in FIGS. 1 and 2, but also can include other, various types of handles such as a "race track" handle or other known types of handle designs. The enclosed carton 10 further generally includes first and second closed ends 26 and 27, with the first end 26 further adapted to become a dispensing or exiting end at which a dispenser 28 (FIG. 1) for the carton is defined, through which containers C can be accessed and dispensed or removed from the carton.

As further shown in FIG. 2, the carton blank 11 additionally includes transverse fifth and sixth fold lines 31 and 32 that extend in a direction perpendicular or normal to the parallel longitudinal fold lines 14, 17, 21 and 22. The fifth and sixth transversely extending fold lines foldably connect the bottom flaps 18 and 19, side panels 13 and 16, and top panel 12 to a series of end flaps, including bottom end flaps 33, first and second side end flaps 34 and 36, and top panel end flaps 37.

In use, the blank 11 will be formed into a carton 10 (FIG. 1) by folding the bottom end flaps 18 and 19 (FIG. 2) inwardly, while the side panels 13 and 16 are folded with respect to the top panel 12 along the first and second fold lines 14 and 17 to form an open ended sleeve. The bottom end flaps then generally are attached or sealed together such as with an adhesive or glue material, although the use of other attachment mechanisms such as locking tabs and corresponding mating slots, or other locking openings formed in the bottom flaps also can be used. Typically, the containers C (FIG. 1) will be loaded into the carton sleeve through one end thereof, with their typically being at least two rows, illustrated at 38 and 39 in FIG. 1, of containers C. It will be understood by those skilled in the art that while this embodiment of the present invention shows the use of two parallel stacked rows of containers, the present invention also can be used with a single row of containers placed side by side, or with three or more parallel rows of stacked containers, such as shown in FIG. 3.

After the carton 10 (FIG. 1) has been fully loaded, the various end flaps at both ends 26 and 27 of the carton 10 generally are folded to a closed position and secured, such as by the application of glue or other adhesive materials or through the use of locking tabs and corresponding mating slots (not shown). For example, the bottom end flaps 33 can be folded upwardly to a closed position, after which the top end flaps 37 will be folded downwardly over the bottom end flaps. The first and second side end flaps 34 and 36 then are folded sideways over the bottom and top end flaps typically with glue or a similar adhesive material being applied therebetween to secure the side, bottom and top end flaps together for closing the ends of the carton 10.

As shown in FIG. 2, a tear line or line of weakness 45 is formed in the carton blank 11 through the side end flaps 31, 36, and through the top panel 12 adjacent the exiting end 26 of the carton. The tear line 45 generally will be formed from a series of perforations, cuts, nicks or scores stamped or otherwise formed in the material of the carton blank and define a removable opening section 46 that defines or creates the dispenser 28 at the exiting end 26 of the carton 10 as shown in FIG. 1.

The tear line 45 generally extends laterally across each of the first and second side end flaps 34 and 35 at the exiting end of the carton so as to define an initial or first lateral portion 47. As shown in FIG. 2, the tear line 45 extends across each of the side end flaps to a first point, 48, whereupon the tear line is turned approximately 60°–90°, or less, and extends along the length of each side end flap for second portions 49 extending substantially parallel to the fifth transverse fold line 31 of the carton blank 11. At a third turning point 50 adjacent the top end flap 37 and top panel 12, the tear line 45 again is turned and includes a third portion 51 that extends along each of the first and second side panels 13 and 16 in a direction parallel to the first and second fold lines 14 and 17, respectively, to a fourth turning point 52 that is spaced inwardly from the exiting end 26 of the carton. The fourth turning point 52 can be selected or formed at any predetermined distance from the exiting end 26 of the carton, but typically will be spaced along the top side panels approximately the diameter of one container C, or greater, as indicated in FIG. 1, for access and removal of a container from the carton.

At the fourth turning point 52 as shown in FIG. 2, the tear line or line of weakness 45 is turned approximately 70°–90° and generally includes a top panel portion or line of weakness 53 that can be formed as a part of the tear line or separately from the tear line 45 and extends laterally across the top panel in a direction substantially parallel to the fifth transverse fold line 31 and exiting end 26 of the carton. The laterally extending top panel portion 53 of the tear line 45 generally defines a hinge line or pivot line about which the removable opening section 46 can be pivoted in the direction of arrows 54 and 54' (FIG. 1) to form or define a dispenser opening 56 that generally is approximately the diameter of one container or greater for access and the dispensing or vending of containers C from within the carton as indicated in FIG. 1.

Still further, a fold line 57 (FIG. 2) can be formed in the removable opening section 46, extending laterally between the second portions 49 of the tear line 45 formed in each of the side panel end flaps, spaced from and extending substantially parallel to the lower or first lateral portion 47 of the tear line. The fold line 57 and first lateral portion 47 of the tear line 45 thus define a gripping or engagement portion or finger flap 58 for the removable opening section 46. In use, a user can push in the engaging portion 58 so as to separate the perforations of the tear lines 45 along the lower lateral portion 47 thereof, after which the removable opening section can be pulled or pivoted upwardly in the direction of arrow 54 to form and open the dispenser opening of the carton. Thereafter, if desired, the removable opening section can be pivoted downwardly in the direction of arrow 54' to re-close the dispenser opening as needed or desired, with the engaging portion 58 providing a tab or other portion by which the removable opening section can be gripped and moved between its opening and closed positions. It is also possible to completely separate the removable opening portion by separating the perforations of the tear line 45 along the laterally extending top panel portion 53 thereof The tear line of the present invention accordingly defines an angled bottom to top opening feature, which, when the opening section is at least partially removed, enables the removal of one or more containers or products at a time, while also enabling easy display and removal of the products therein by consumers. In addition, the design of the dispenser 28 includes front retainer portions or sections 61 and 62 that extend in a substantially L-shaped configuration that allows enhanced visibility of the products or containers within the carton, but restricts the containers from falling out of the cartons before dispensing is desired.

Figure 4:
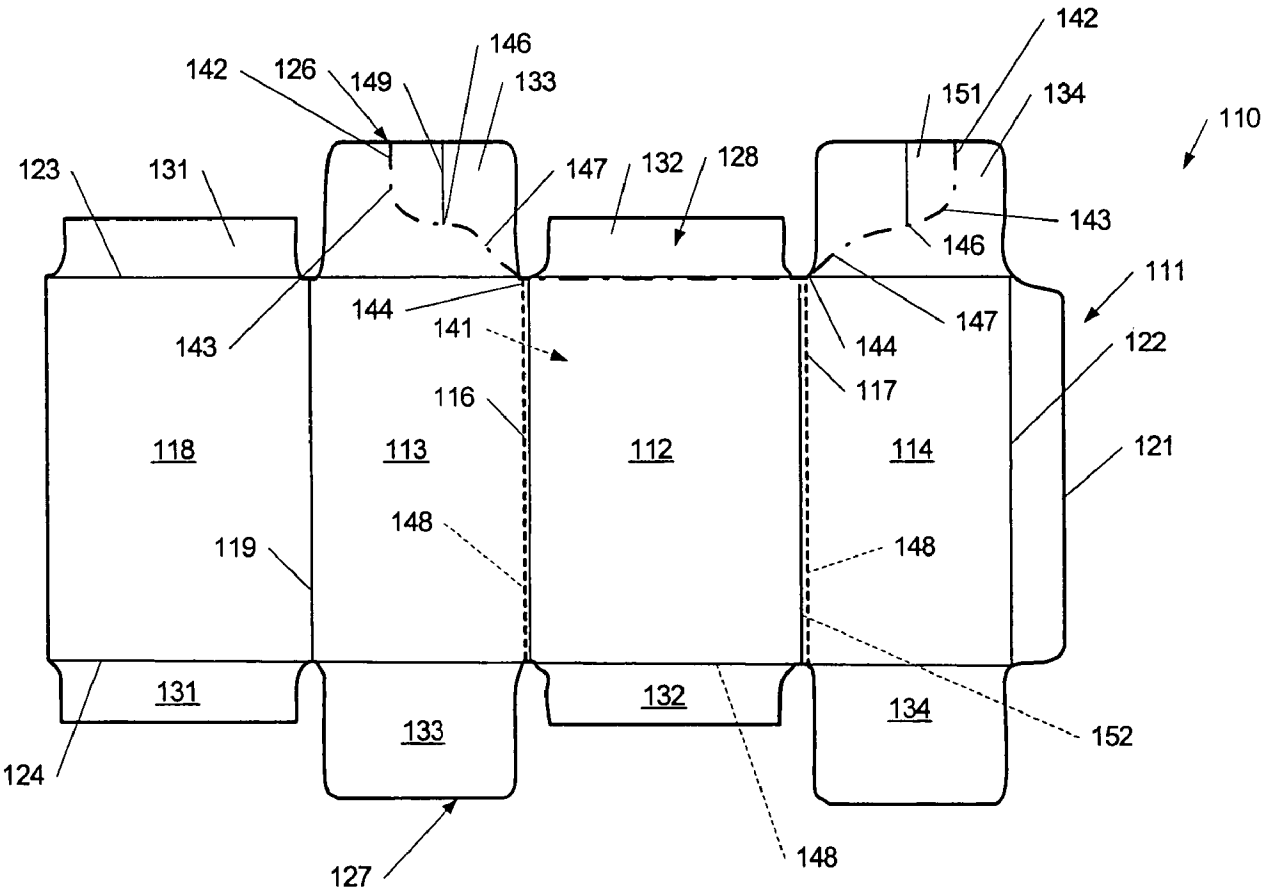
FIG. 4 is a plan view of a carton blank from which the display/vending carton of FIG. 3 is formed.

FIGS. 3 and 4 illustrate another example embodiment of a carton 100 of the present invention, which is designed with angled bottom to top opening feature to enable removal of products one at a time. As illustrated in FIG. 4, the carton generally is formed from a carton blank 111, typically formed from a paperboard, cardboard, synthetic or other similar carton material. In this embodiment, the carton blank generally includes a top panel 112 connected to first and second side panels 113 and 114 along first and second longitudinally extending fold lines 116 and 117, respectively. The first side panel 113 further is foldably connected to a bottom panel 118 along a third longitudinal fold line 119, while the second side panel 114 is connected to a bottom attachment flap 121 by a fourth longitudinally extending fold line 122. In use, the bottom flap 121 will be folded inwardly and attached to the bottom panel 118, such as by glue or other similar adhesive material, or can be locked together with the bottom panel via locking tabs and slots (not shown) to form an open ended sleeve for receipt of products therein. As discussed above with respect to FIGS. 1 and 2, the products typically will be received within the open-ended carton sleeve on their sides, arranged in parallel rows.

Transversely extending fifth and sixth fold lines 123 and 124 extend across the ends of the top, side and bottom panels at each end 126 and 127 of the carton 110. As indicated in FIG. 3, the first end 126 of the carton 110 generally is defined as an exiting end of the carton, at which a dispenser 128, having a dispenser opening 129, is defined and through which the containers C can be accessed and dispensed from the carton. Bottom, top, and first and second side end flaps 131–134, respectively, are attached to the bottom, top and first and second side panels at each end of the carton along the fifth and sixth transverse fold lines 123 and 124 as shown in FIG. 4. After the bottom, side and top panels have been folded into a sleeve or tube and loaded with products, the bottom, top and side panels 131–134 generally will be folded inwardly to a closed configuration to seal and close the opposite ends 126 and 127 of the carton and will be attached, typically with an adhesive material such as glue or other attachment mechanism to secure the flaps in their closed condition.

As further illustrated in FIG. 4, a tear line 140 or a line of weakness or separation is formed at the exiting end 260 of the carton blank such as by cutting, scoring, stamping or otherwise forming a series of scores, nicks, cuts or perforations in the blank. The tear line extends along the top panel 112 adjacent the first and second fold lines 116 and 117 to form a removable opening section 141 of the carton 110 (FIG. 3) for defining the dispenser 128 of the carton. The tear line 140 initially extends laterally across the first and second side end flaps 133 and 134 defining a lower, lateral or first portion 142 that extends across each of the first and second side end flaps between first turning points 143 at which the tear line is turned and extends at a curve or angle upwardly along each of the first and second side end flaps as shown in FIG. 4. The tear line can extend upwardly at an angle from the first turning points 143 to a second turning point 144 along each of the side end flaps. Alternatively, as indicated in FIG. 4, the tear line also can extend at an angle to a first intermediate point 146 and thereafter can be turned slightly and extend substantially parallel to the fifth transverse fold line 123 until it reaches the second turning points 144. Upon reaching turning points 144, the tear line generally again is turned and extends at an angle toward the first and second fold lines 116 and 117 between the top and first and second side panels, respectively.

As shown, the tear line typically will include an angled or curved portion 147 extending approximately between each of the first turning points 143 or the intermediate points 146 and the second turning point 144 adjacent the first and second fold lines 116 and 117, which angle can be varied up to approximately 90° to vary the size of the removable opening section 141 or dispenser opening 129, as desired. In addition, the angled portion 147 further can extend at least partially along the first and second side panels, such as in the embodiment shown in above in FIG. 2 as needed and desired for access to the containers within the carton 100 (FIG. 3) formed from the blank 111, FIG. 4. As further indicated in FIG. 4, the tear line 140 further generally can be extended substantially the length of the top panel, generally being extended along or adjacent and parallel to the first and second fold lines 116 and 117 as indicated in FIG. 4 by dashed lines 148. As a result, the removable section 141 thus can include substantially the entire top panel to define a dispenser opening 129 that extends substantially along the length of the carton to enable access and removal of entire rows of containers from within the carton as indicated in FIG. 3.

Still further, a fold line 149 can be formed in the front of the removable section 141 extending across the first and second side end flaps 133 and 134 (FIG. 4) and substantially parallel to the lateral portion 142 of the tear line between the first intermediate points 146. The fold line 149 defines a finger flap or engaging portion 151 for the removable opening section. In use, a user will press against the inner flap or engaging portion 151 so as to initiate the tearing or separation of the tear line along the lower lateral portion 142 thereof. To open the carton 100, the user can grip and pull or move the removable opening section 141 upwardly in the direction of arrow 152 as shown in FIG. 3, separating the removable section from the remainder of the carton along the tear line 140 to form the dispenser opening 129.

In this embodiment, the dispenser opening 129 is shown as being substantially the size of the top panel, i.e., with the top panel 112 being substantially removed from the carton so as to expose the entire upper row of containers C to enable easier and faster access and removal thereto. The removable opening section 141 further can be torn away or completely removed from the carton with the carton thus being used as a display and dispensing or vending carton such as in a retail environment. Alternatively, as shown in FIG. 3, essentially completely removing the top panel enables access to all containers C stored within the carton 100 and permits the next containers to roll or drop down into a forward position for easier access and removal, while at the same time, enabling enhanced visibility of the containers within the carton while they are retained and prevented from falling out of the carton. It is also possible, however, to form one or more fold or tear lines or lines of weakness, such as indicated by dashed lines 153 in FIG. 3, along the top panel at spaced locations. This will enable only partial removal of part of the top panel 112 as needed for controlling access to the containers contained within the carton and, in instances where the carton will be resealed, the removable section can be lowered back to a closed position as indicated by arrow 152'.

It will be understood by those skilled in the art that while the present invention has been discussed above with respect to various preferred embodiments and/or features thereof, numerous changes, modifications, additions and deletions can be made thereto without departing from the spirit and scope of the invention as set forth in the following claims.

What is claimed is:

1. A blank for forming an enclosed carton for a plurality of containers in at least two rows, with a top row and a bottom row, the blank comprising:

a) a first bottom flap connected to one edge of a first side panel by a first fold line, a top panel connected at one edge to an opposite edge of the first side panel by a second fold line, a second side panel connected at one edge to an opposite edge of the top panel by a third fold line, and a second bottom flap connected to the opposite edge of the second side panel by a fourth fold line;

b) a first side end flap joined to one end of the first side panel by a fifth fold line, and a second side end flap joined to a corresponding end of the second side panel by a sixth fold line and a top end flap connected to the top panel by a seventh fold line;

c) a tear line extending across the first and second side end flaps to a first point, thereupon the tear line is turned and extends longitudinally along the first and second side end flaps toward the fifth and sixth fold lines, respectively, to a second point closer to the top end flap, whereupon the tear line is turned and extends along the side panels adjacent the second and third fold lines to a further point at which the tear line intersects with a line of weakness extending across the top panel; and d) the tear line defining a removable opening section of the enclosed carton for forming dispenser opening when the enclosed carton is formed from the blank.

2. The blank of claim 1 and further comprising a fold line extending across the first and second side end flaps between the first and second points of the tear line to define a flap in the removable opening section.

3. The method of forming the blank of claim 1 into a carton, comprising the steps of:

a) attaching the first wad second bottom flaps together to form a sleeve;

b) loading the containers into the sleeve; and c) attaching together bottom end flaps, which are foldably attached to the first and second top flaps, the side end flaps and the top end flap at each end of the sleeve.

4. The method of claim 3, wherein the containers are loaded into the sleeve on their sides, to form the top row and the bottom row, with each said container in the top row being positioned directly above a corresponding container in the bottom row.

5. The method of claim 3, wherein the containers are cylindrical and are loaded into the sleeve on their sides to form the top row, the bottom row, and at least one intermediate row of containers, between the top and bottom rows.

6. The blank of claim 1, wherein a width of the top panel is substantially equal to a width of at least one of the side panels.

7. The blank of claim 1, further comprising a handle in the top panel.

8. The blank of claim 1, wherein the tear line extends to edges of the first and second side end flaps.

9. An enclosed canon for a plurality of containers in multiple rows stacked one on the top of another, including a top row and a bottom row, the carton comprising:

a top panel, two side panels, at least one bottom panel, and two closed ends, including an exiting end; wherein the top panel, the two side panels, and the at least one bottom panel are separated by longitudinal fold lines;

transverse fold lines at each of the closed ends; wherein the transverse fold lines define end flaps for the top panel, the two side panels, and the at least one bottom panel; and a tear line formed at the exiting end of the carton, extending across the end flaps of the side panels at the exiting end of the carton to a first point, and thereafter turning and continuing through each of the end flaps to a second point whereupon the tear line is turned and extends parallel to the longitudinal fold lines between the top and side panels to a third point at which the tear line is turned toward the top panel to define an opening section adapted to be hinged to the carton;

wherein the top row includes a top end container and the bottom row includes a bottom end container and wherein the top end container and the bottom end container contact the existing end of the enclosed carton.

10. The enclosed carton of claim 9 and further comprising a line of weakness extending across the top panel and between the side panels and intersecting with the tear line.

11. The enclosed carton of claim 9 wherein the containers are loaded into the sleeve on their sides, to form the top row and the bottom row, with each said container in the top row being positioned directly above a corresponding container in the bottom row.

12. The enclosed carton of claim 9, wherein the containers are cylindrical and are loaded into the sleeve on their sides to form the top row, the bottom row, and at least one intermediate row of containers, between the top and bottom rows.

13. The carton of claim 9, wherein the top panel extends across at least substantially all of a top of the enclosed carton.

14. The carton of claim 9, further comprising a handle in the top panel.

15. An enclosed carton for a plurality of cylindrical containers in stacked, parallel rows, including a top row and a bottom row, the carton comprising:

a top panel, two side panels, at least one bottom panel, and two closed ends, including an exiting end; wherein the top panel, the two side panels, and the at least one bottom panel are separated by parallel fold lines;

transverse fold lines at each said closed end; wherein the transverse fold lines define top end flaps for the top panel, side end flaps for the two side panels, and bottom end flaps for the at least one bottom panel;

a continuous tear line defining a removable opening section that forms a dispensing opening that extends across the side end flaps and along the top panel and top and side end flaps of the exiting end and which extends along the top panel a distance of at least one container diameter to allow access to the containers in the enclosed carton, said removable opening section being adapted to be hinged to said carton;

wherein the top row includes a top end container and the bottom row includes a bottom end container and wherein the top end container and the bottom end container contact the exiting end of the enclosed carton.

16. The carton of claim 15 and further comprising a fold line extending across the first and second side end flaps between the first and second points of the tear line to define a flap in the removable opening section.

17. The carton of claim 15 and wherein said bottom panel comprises a first bottom flap and a second bottom flap folded into an overlying relationship to form the bottom panel.

18. The carton of claim 15 wherein the containers are cylindrical and are loaded into the sleeve on their sides to form the top row, the bottom row, and at least one intermediate row of containers, between the top and bottom rows.

19. The carton of claim 15, wherein the top panel extends across at least substantially all of a top of the enclosed carton.

20. The carton of claim 15, further comprising a handle in the top panel.

21. An enclosed carton for a plurality of containers in two or more stacked rows, including a top row and a bottom row, the carton comprising:

a top panel, two side panels, at least one bottom panel, and two closed ends, including an exiting end; wherein the top panel, the two side panels, and the at least one bottom panel are separated by parallel fold lines that separate the top panel from each said side panel;

transverse fold lines space from each said closed end, wherein the transverse fold lines define end flaps for the top panel, the two side panels, and the at least one bottom panel; and a continuous line of weakness formed across the end flaps of the side panels at the exiting end of the enclosed carton and proceeding through each said side panel for a desired distance whereupon the line of weakness is turned and extends across the top panel to define a removable opening section at the exiting end of the carton, at least a portion of which is separable from the carton along the line of weakness for forming a dispenser opening through each said side panel flap for dispensing one or more containers at a time.

22. The carton of claim 21, wherein the containers are loaded into the sleeve on their sides, to form the top row and the bottom row, with each said container in the top row being positioned directly above a corresponding container in the bottom row.

23. The carton of claim 21, wherein the containers are cylindrical and are loaded into the sleeve on their sides to form the top row, the bottom row, and at least one intermediate row of containers, between the top and bottom rows.

24. The carton of claim 21 and wherein said bottom panel comprises a first bottom flap and a second bottom flap folded into an overlying relationship to form the bottom panel.

25. The canon of claim 21 and further comprising a fold line extending across the first and second side end flaps between the first and second points of the tear line to define a flap in the removable opening section.

26. The carton of claim 21 and wherein the portion of the tear line extending across the top panel defines a hinge about which the removable opening section is pivoted to form a dispenser opening for the carton.

27. The carton of claim 21, wherein the top panel extends across at least substantially all of a top of the enclosed carton.

28. The carton of claim 21, further comprising a handle in the top panel.

29. A blank for forming an enclosed carton for a plurality of containers in two or more stacked rows, the carton comprising:

a top panel, two side panels, at least one bottom panel and two closed ends, including an exiting end; wherein the top panel, the side panels, and the at least one bottom panel are separated by parallel fold lines;

transverse fold lines spaced from each said closed end; wherein the transverse fold lines define end flaps for the top panel, the side panels, and the at least one bottom panel;

a tear line that extends through at least the side end flaps at an exiting end of the carton and through and along at least a portion of the side panels for forming a dispenser at the exiting end and for dispensing one or more containers;

wherein the tear line comprises a continuous line of perforations that proceeds through each side panel and flaps for a substantially horizontal portion and a substantially vertical portion toward, into and along each said side panel end to define a removable opening section forming said dispenser.

30. The blank of claim 29, wherein a width of the top panel is substantially equal to a width of at least one of the side panels.

31. The blank of claim 29, further comprising a handle in the top panel.

32. The blank of claim 29, wherein the tear line extends to edges of the first and second side end flaps.

* * * * *